United States Patent [19]

Matsunaga et al.

[11] Patent Number: 4,841,408

[45] Date of Patent: Jun. 20, 1989

[54] ELECTROCONDUCTIVE SLIDING APPARATUS

[75] Inventors: Shigeki Matsunaga, Tokyo; Yuichi Ishikawa, Yokohama; Masachi Hosoya, Fujisawa, all of Japan

[73] Assignee: Nippon Seiko Kabushiki Kaisha, Tokyo, Japan

[21] Appl. No.: 111,674

[22] Filed: Oct. 21, 1987

[30] Foreign Application Priority Data

Oct. 31, 1986 [JP] Japan ..... 61-258550
Dec. 26, 1986 [JP] Japan ..... 61-308893
Jun. 15, 1987 [JP] Japan ..... 62-146862

[51] Int. Cl.[4] ..... H05F 3/02
[52] U.S. Cl. ..... 361/220
[58] Field of Search ..... 361/212, 220, 221; 174/6; 252/510

[56] References Cited

U.S. PATENT DOCUMENTS 4,043,616 8/1977 Zimmer ..... 384/133
4,287,551 9/1981 Watanabe ..... 361/212
4,538,019 8/1985 Bramwell et al. ..... 174/6
4,604,229 8/1986 Raj et al. ..... 252/510
4,623,952 11/1986 Pexton ..... 361/220

*Primary Examiner*—L. T. Hix
*Assistant Examiner*—Brian W. Brown
*Attorney, Agent, or Firm*—Gifford, Groh, Sheridan, Sprinkle and Dolgorukov

[57] ABSTRACT

An electroconductive sliding apparatus for electrically connecting a first member to a second member, both of which members are relatively moving and electroconductive by means of an electroconductive contactor, said apparatus comprising: a magnetic fluid, which is retained by means of the magnetic force between said first and/or second members, placed at the slidable contact point of said first and/or second members with said contactor; said first and/or second members and said contactor being brought into close proximity capable of metal contact or electroconduction by means of the force applied to said contactor and at said slidable contact point at which said magnetic fluid is placed.

28 Claims, 13 Drawing Sheets

ELECTROCONDUCTIVE SLIDING APPARATUS

BACKGROUND OF THE INVENTION

1. Field of the Invention

The present invention relates to an electroconductive sliding apparatus for electrically connecting two relatively moving electroconductive members, and more particularly to an apparatus for grounding static electricity developed on the surface of a disk for a magnetic disk apparatus and the like.

2. Description of the Prior Art

Conventional apparatuses of this type are typified by the following three examples. The first example involves an apparatus using a sliding member as shown in FIG. 22 (refer to Japanese Laid-open Utility Model, Application No. 126,495/1986).

The apparatus is composed of an electroconductive sliding member 3 energized on the side of a shaft 1, by means of a spring plate 2, between an electroconductive shaft (first member) and an electroconductive spring plate (second member), the shaft 1 being electrically connected to the spring plate 2 by means of the sliding member 3. The sliding member 3 is integrally formed on the spring plate 2 prepared by blending a solid lubricator with the surface coated with nickel, carbon fiber and a synthetic resin in a definite proportion.

The second example (not shown) includes an apparatus using a mercury slip ring between two relatively moving electromotive members.

The third example includes an electroconductive sliding apparatus used for a magnetic disc apparatus disclosed in U.S. Pat. No. 4,604,229. The apparatus is, as shown in FIG. 23, composed of an electroconductive magnetic fluid 8 interposed between a magnetic shaft (first member) 4 and a magnetic pole piece (second member) 7 immovably attached, on both sides of a magnet 6, to the internal periphery of a non-magnetic, electroconductive housing 5, thereby sealing between the shaft 4 and the pole piece 7 and electrically connecting the shaft to the piece.

In the first example (FIG. 22), the electroconductive sliding member 3 which is brought into direct, resilient contact with the shaft 1 is electrically connected to the shaft 1 and plate 2 but lacks lubricativity even when it contains solid lubricant. Accordingly, rotation of the shaft 1 may, with time, cause abrasion of the sliding member and increased or uneven torque, thus finally causing vibration and noise. For the same reason, the shaft 1 which rotates at a high speed may cause heat and adverse effect on the apparatus.

In the second example (not shown), the slip ring using mercury, the two electroconductive members can be electrically connected by mercury, and lubrication is also possible therebetween. However, mercury, fluid and volatile, makes the sealing mechanism complex and the apparatus expensive. The toxicity of mercury makes apparatus handling difficult.

In the third example (FIG. 23), lubrication between the shaft 4 and the pole piece 7 is performed effectively, but the electroconductivity is quite high, because the gap distance is usually about 200 μm, so that the layer of the electroconductive, magnetic fluid 8 therebetween is quite thick. The experimental value of the electroconductance was from $10^7$ to $10^8$ ohms and was nearly ineffective for removing the static electricity of the disk mounted on the shaft 4. Although U.S. Pat. No. 4,604,229 describes that a magnetic fluid with an electroconductance of several kilohms is manufacturable; the fluid increases contact torque due to increased viscosity with decreased resistance. When torque in a practical level is to be realized, the value of the resistance of the magnetic fluid will be as great as several megohms. Grounding of static electricity will require that the resistance between the shaft 4 and the pole piece be as low as several kilohms or less. In view of this fact, electrical connection therebetween would not be satisfactory.

SUMMARY OF THE INVENTION

The present invention is intended to solve the conventional problems as described above. The purpose of the present invention is to provide an inexpensive electroconductive sliding apparatus which is simultaneously capable of ensuring lubricativity and electroconductivity at the slidable point.

The electroconductive sliding apparatus in the present invention for electrically connecting a first member to a second member, both of which are relatively moving and electroconductive, by means of an electroconductive slider comprises a magnetic fluid, which is retained by means of magnetic force between the first and/or second members, placed at the slidable point between the first and or second members; the first and/or second members and the slider being brought into close proximity capable of metal contact or electroconduction by means of the force applied to the slider at the slidable point at which the magnetic fluid is placed.

According to the above structure, the point at which the first member and/or the second member are brought into metal to metal contact with the slider, or the contact piece and the point at which both members and the slider piece are brought into a near-electroconductive position are lubricated by a magnetic fluid placed at the points. Both the members and the slider are simultaneously capable of electroconduction at a point where they are brought close to a position capable of metal contact or electroconduction. Accordingly, the relatively moving first and second members can be electrically connected by the slider.

Lubrication among the first and/or second member and the contact piece can utilize a magnetic fluid for sealing between the first and the second members. Retention of the magnetic fluid can be performed in a simple structure, because it is effected by magnetic force. The magnetic fluid itself requires no sealing mechanism for the prevention of evaporation, because it does not evaporate, unlike when mercury is used as a lubricant. Thus, the apparatus is less expensive than the mercury slip ring.

BRIEF DESCRIPTION OF THE DRAWINGS

FIG. 3(*b*), a sectional view of FIG. 3 (*a*);

FIG. 4(*b*), a main portion enlarged view of FIG. 4(*a*);

FIG. 6(*b*), a sectional view of FIG. 6(*a*);

FIG. 14(*b*), a sectional view of FIG. 14(*a*);
FIG. 15(*b*), a perspective diagram of a retainer in FIG. 15(*a*);
FIG. 17(*b*), a main portion enlarged view of FIG. 17(*a*);
FIG. 18(*b*), a sectional view of FIG. 18(*a*);
FIG. 19(*b*), a sectional view of Embodiment 19(*a*);
FIG. 20(*b*), a sectional view of FIG. 20(*a*);
FIG. 21(*b*), a sectional view of FIG. 21(*a*)

Figure 1:
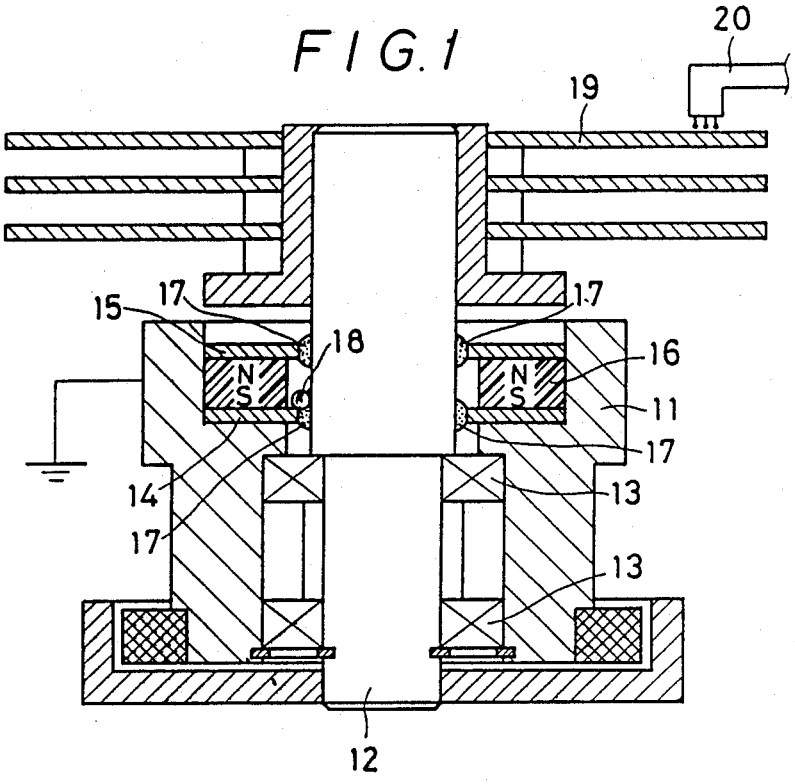
FIG. 1 is a sectional view showing Embodiment 1 of the present invention.

12: Shaft (first member)
14 and 15: Pole pieces (second members)
17: Magnetic fluid
18: Ball (contactor)

DETAILED DESCRIPTION OF THE PREFERRED EMBODIMENTS

Embodiments of the present invention are described with reference to FIGS. 1 to 21.

In the drawings, the same portions and the corresponding portions are represented by the same codes.

Embodiment 1

Figure 2:
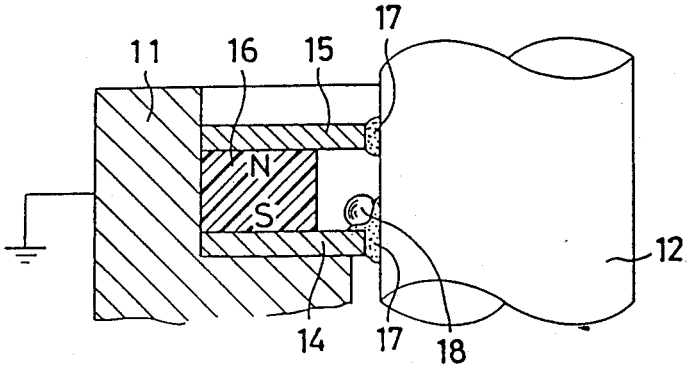
FIG. 2, portion enlarged view of FIG. 1.

FIGS. 1 and 2 illustrate the first embodiment of the present invention, as applied to a magnetic disc apparatus.

In the drawings, a numeral 11 denotes a tubular housing, and 12 denotes a shaft (first member) attached to the housing 11 through the intermediary of a bearing 13. Annular pole pieces (second member) 14 and 15 are immovably attached to the internal wall of the housing 11 on both sides of annular magnets 16 by means of an electroconductive adhesive to be disposed around a shaft 12. The housing 11 is non-magnetic and electroconductive, whereas the shaft 12 and the pole pieces 14 and 15 are magnetic, electroconductive bodies. The numeral 17 denotes a magnetic fluid retained by the magnetic force between the shaft 12 and the pole pieces 14 and 15, that is, a magnetic fluid retained by the magnetic field established among the shaft 12 and the pole pieces 14 and 15 by a magnet 16. The magnetic fluid 17 is used for sealing among the shaft 12 and the pole pieces 14 and 15, thereby protecting the bearing 13 from dust.

A magnetic, electroconductive ball (slider) 18 is adsorbed on the members 12 and 14 by the attraction due to the magnetic field established between the shaft 12 and the pole piece 14. A portion of the magnetic fluid 17 is retained by the magnetic field established by the magnet 16 among the adsorbed ball 18, the pole piece 14 and the shaft 12 or at the slidable point. In other words, the ball 18 is adsorbed on the shaft 12 and pole piece 14 by the attraction (magnetic force) of the magnet 16 through the intermediary of the magnetic fluid 17.

The ball (slider) is brought into a close proximity which enables metal contact with and electroconduction to the shaft 12 because of the magnetic field being exerted thereon. The numerals 19 and 20 denote a disk mounted on the shaft 12 and a magnetic head, respectively.

The action is as described below.

The portion at which the shaft 12, the pole piece 14 and the ball (slider) 18 are in metal contact or a portion at which they are brought into a close proximity capable of electroconduction is lubricated by the magnetic fluid 17 retained thereat.

Because the shaft 12, the pole piece 14 and the ball 18 are in metal contact, or are brought into a close proximity capable of electroconduction at these slidable points, they are capable of electroconduction at the portions described above. Because the pole piece 14 is immovably attached to the housing 11 by means of an electroconductive adhesive, when they become electroconductive, the shaft 12 is electrically connected to the housing 11. Static electricity developed on the disk 19 is grounded via the shaft 12, the pole piece 14 and the housing 11. The value of resistance was measured at about 10 ohms.

Lubrication among the shaft 12, the pole piece 14 and the ball (slider) 18 can be performed using the magnetic fluid 17 for sealing between the shaft 12 and the pole piece 14, and the magnetic fluid can be retained by the magnetic force of the magnet 16. For this reason, the structure for retaining the magnetic fluid is simpler than that for retaining mercury. The magnetic fluid requires no sealing mechanism for the prevention of evaporation, because the magnetic fluid itself does not evaporate, unlike mercury. Accordingly, an electroconductive sliding apparatus can be constructed at a low cost.

An electroconductive, magnetic fluid can be used instead of the magnetic fluid 17.

Embodiments 2 to 4

Figure 3:
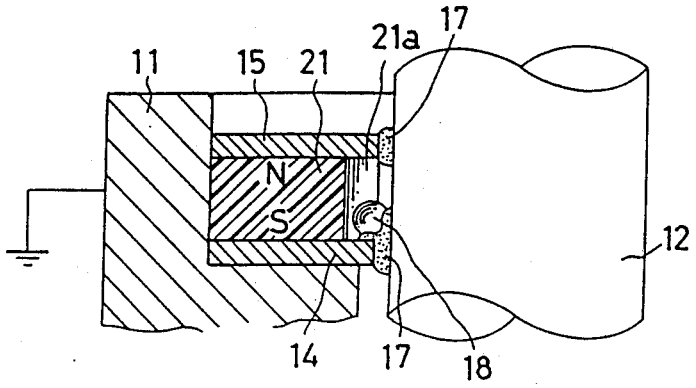
FIG. 3(*a*), a sectional view of Embodiment 2.
Figure 3:
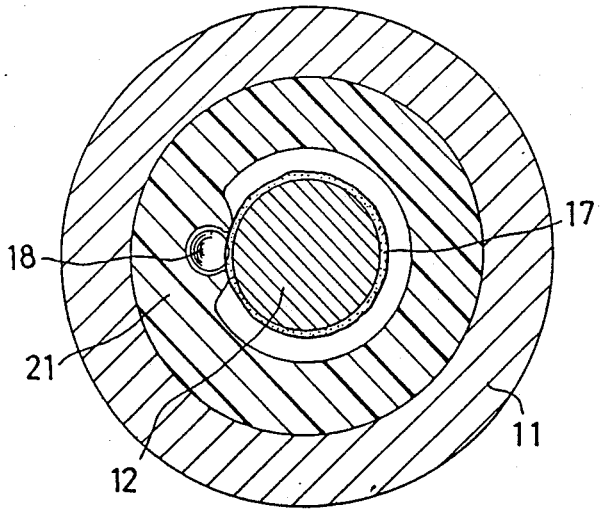

FIG. 3 illustrates the second embodiment. One axial groove 21*a* is provided on the internal side of a magnet 21 to restrain the ball (slider) 18 therein, and the remainder of the structure is the same as that of Embodiment 1.

Figure 4:
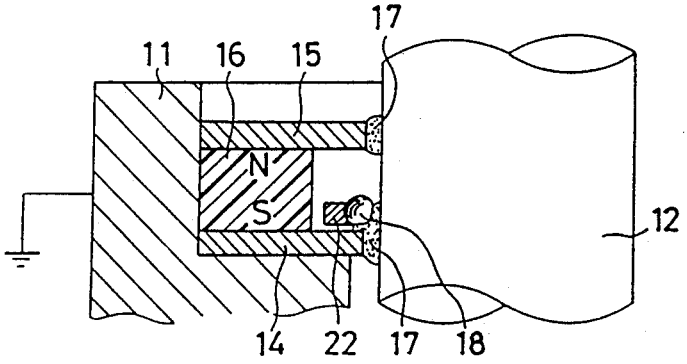
FIG. 4(*a*), a sectional view of Embodiment 3.
Figure 4:
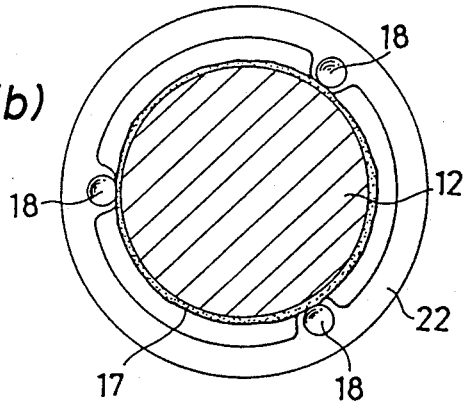

FIG. 4 illustrates the third embodiment. A magnetic ball (slider) 18 retained in a plastic cage (retainer) 22 is fitted to a shaft (first member) 12, and the ball (slider) 18, the shaft 12 and a pole piece (second member) 14 are, as in the case of Embodiment 1, brought into metal contact or into a close proximity capable of electroconduction utilizing the magnetic force of a magnet 16. The rest of the structure is the same as that of Embodiment 1.

Figure 5:
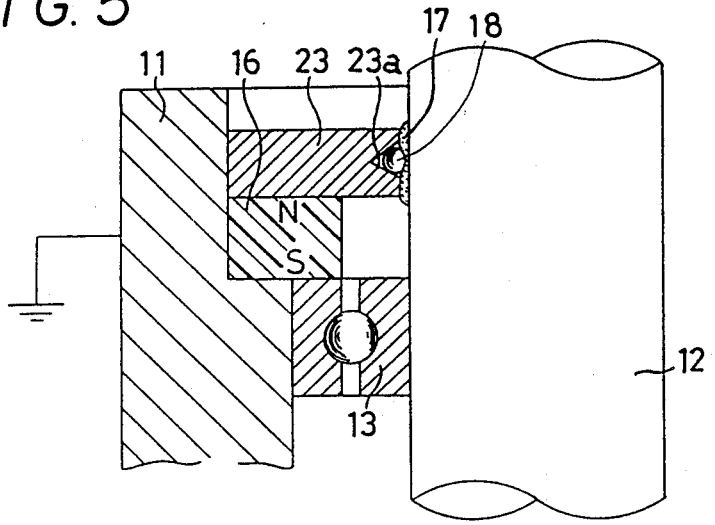
FIG. 5, a sectional view of Embodiment 4.

FIG. 5 illustrates the fourth embodiment. In the structure, in which a magnetic path is established by the magnet 16, the pole piece (second member) 23, the bearing 13 and the shaft (first member) 12. The magnetic flux in this case retains a magnetic fluid 17 between the pole piece 23 and the shaft 12 and restrains the ball (contactor) in a groove 23*a* in the inner periphery of the pole piece 23. The structure in which the ball 18, the pole piece 23 and the shaft 12 contact through the intermediary of a portion of the magnetic field is the same as that of Embodiment 1. In FIGS. 3 to 5, portions which are the same as or corresponding to FIGS. 1 and 2 are represented by the same codes.

The action and effect in Embodiments 2 to 4 are not essentially different from those of Embodiment 1. However, hey are more advantageous than Embodiment 1, in that stable electroconductive contact of the ball (slider) 18 with the pole pieces 14 and 23 can be ensured, because the groove 21*a*, the plastic cage 22 and the groove 23*a* restrain the ball 18 in Embodiments 2, 3 and 4.

Embodiment 5

Figure 6A:
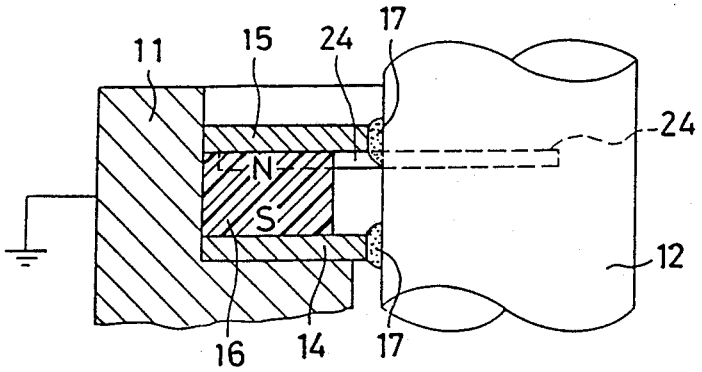
FIG. 6(*a*), a sectional view of Embodiment 5.
Figure 6B:
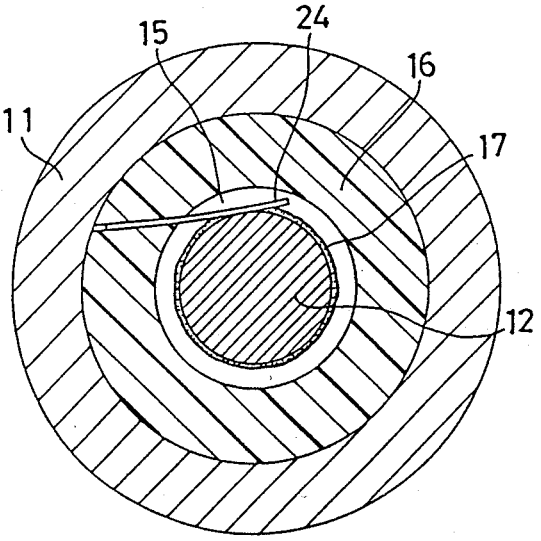

FIG. 6 illustrates the fifth embodiment which is applied to a magnetic disk apparatus as the case with the above embodiments. It differs from the above embodiments in that an electroconductive bar-type magnetic spring member 24 is used as a slider, one end of which is brought into resilient contact with a shaft (first member) 12 at the portion of a magnetic fluid 17 and the other end of which is affixed to a magnet 16 to bring it into metal contact with a shaft (first member) 12 at the portion of a magnetic fluid 17 and the other end of which is fixed to a magnet 16 to bring it into metal contact with a pole piece (second member) 15. Unlike Embodiments 1 to 4, metal contact or approach to a proximity capable of electroconduction at the slidable contact point of the magnetic spring member 24, which is a contact segment with the shaft (first member), is performed by means of the flexible deformation-derived stability (spring force) of the magnetic spring member 24, whereas electrical connection at the non-sliding contact portion of the magnetic spring member (contact segment) to the pole piece (second member) is performed by metal contact without the aid of the magnetic fluid. The action and effect are the same as those in Embodiments 1 to 4. The advantage of Embodiment 5 is the ensured stability of electroconduction of the magnetic spring member 24 and the shaft 12, because resilient force is utilized for metal contact in the slidable contact point.

Embodiment 6

Figure 7:
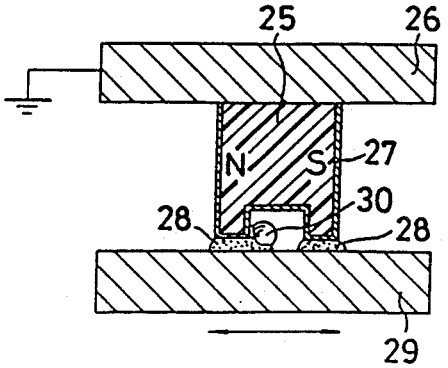
FIG. 7, a sectional view of Embodiment 6.

FIG. 7 illustrates an Embodiment applied to a slide bearing. In this Embodiment, a magnetic electroconductive film 27 (second member), used for coating the surface of a magnet 25 and immovably attached to a fixing plate 26 together with the magnet 25 for enabling electroconduction, is electrically connected by means of a magnetic ball (contact segment) 30 to a magnetic slide plate (first member) 29 with a magnetic fluid 28, retained by the magnetic force of the magnet 25, interposed between the magnetic electroconductive plate 27 and the slide film 29. The structure of the ball (slider) 30 and the slidable point of the magnetic electroconductive film 27 with the slide plate 29 is the same as that of Embodiment 1 and does not differ therefrom with regard to the action and effect. The fixing plate 26 is a non-magnetic body; while the slide plate 29 and the ball 30 are magnetic bodies.

Embodiment 7

Figure 8:
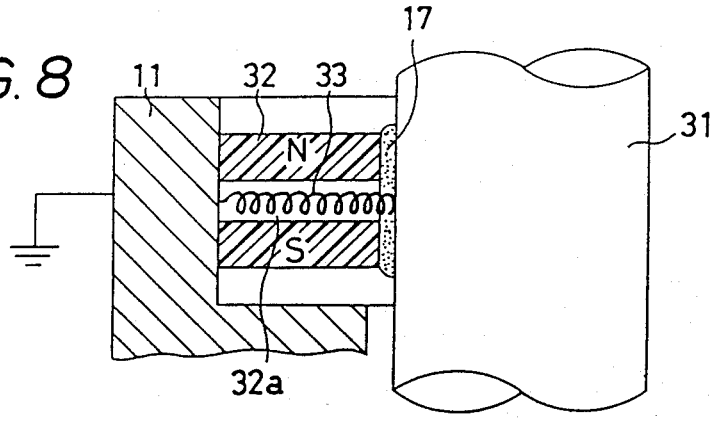
FIG. 8, a sectional view of Embodiment 7.

FIG. 8 illustrates the seventh embodiment as applied to a magnetic disk apparatus. The numeral 31 denotes a shaft first member) and 32 denotes an annular magnet immovably attached to the inside surface of housing 11. The numeral 33 denotes a spring member (slider) inserted into the hole 32*a* of the magnet 32 with the base end affixed to the housing 11, thereby being brought into resilient contact with the shaft 31. The housing 11 and the magnet 32 compose the second member of the present invention. The shaft 31, the housing 1 1 and the spring member 33 are all electroconductive, non-magnetic bodies. A magnetic fluid 17 is retained by the magnetic force of the magnet 32 and the shaft 31.

Because the end of the spring member (slider) 33 is placed in the magnetic fluid 17 and subjected to resilient contact resulting from the shaft 31 and its own spring force, the magnetic fluid 17 is always present between the spring member (slider) 33 and the shaft 31. Although the action and effect are the same as those in Embodiment 1, Embodiment 7 is more advantageous in that contact of the spring member (slider) 33 with the shaft 31 is easily performed.

Embodiment 8

Figure 9:
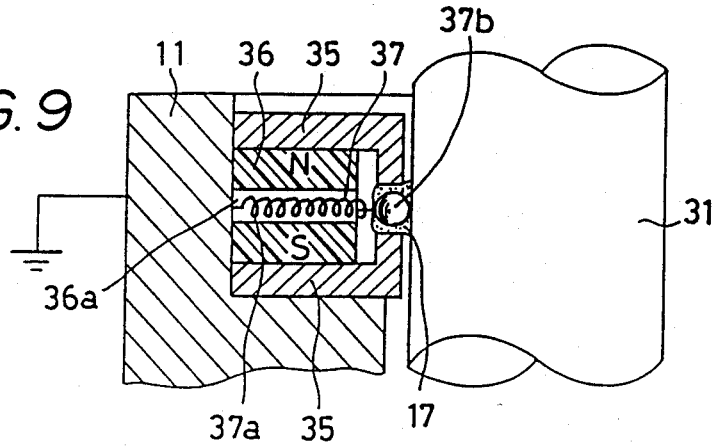
FIG. 9, a sectional view of Embodiment 8.

FIG. 9 illustrates the eighth embodiment, in which the numerals 35 and 35 collectively denote pole pieces, 36 denotes a magnet and 37 denotes a spring-loaded ball (slider). The pole pieces 35 and 35 and a housing 11 compose the second member of the present invention. the spring-loaded ball 37, the shaft 31, and the housing 11 are non-magnetic bodies and the pole piece 35 is a magnetic body, all of which are electroconductive. The spring 37*a* of the ball 37 is inserted into the hole 36*a* of the magnet 36 to be affixed to the housing 11 and the ball 37*b* is brought into resilient contact with the shaft 31 (first member) by means of the resilient force of the spring 37*a*. A magnetic fluid 17 retained by the magnetic force of the magnet 36 between the pieces 35 and 35, seals among the shaft 31 and the poles pieces 35 and 35. The ball 37*b* is inserted into the sealing magnetic fluid 17 to be brought into resilient contact with the shaft 31, so that the magnetic fluid 17 is always present between the ball 37*b* and the shaft 31.

The action and the effect do not differ from those of Embodiment 1, and metal contact is easily performed as is the case with Embodiment 7.

Embodiment 9

Figure 10:
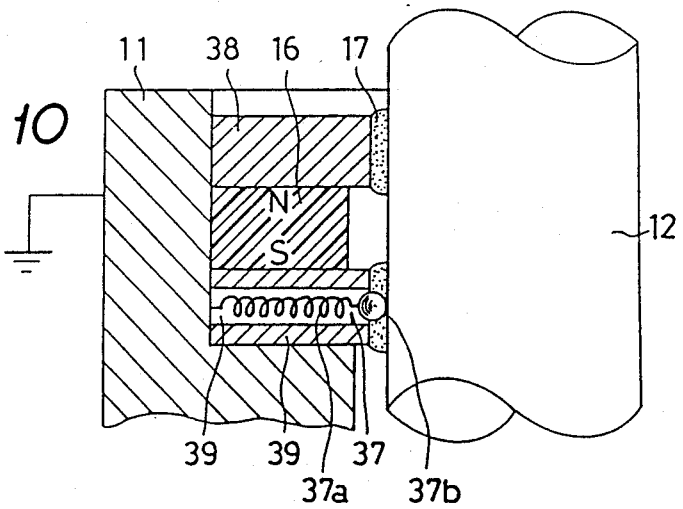
FIG. 10, a sectional view of Embodiment 9.

FIG. 10 illustrates Embodiment 9, in which the numerals 38 and 39 denote pole pieces, wherein the spring 37*a* of a spring-loaded ball 37 is inserted into the hole 39*a* of one pole piece 39 to be affixed to a housing 11, and the ball 37*b* is brought into resilient contact with a shaft (first member) 12 by means of the resilient force of the spring 37*a*. The pole pieces 38 and 39 and the housing 11 constitute the second member of the present invention, in which the spring-loaded ball slider 37 and the housing 11 are nonmagnetic bodies and the pole pieces 38 and 39 and the shaft 12 are magnetic bodies, all of which are electroconductive. The magnetic fluid 17 retained by the magnetic force of a magnet 36 at the position seals among the shaft 12 and the pole pieces 38 and 39.

The ball 37*b* is inserted into the magnetic fluid 17 and is brought into resilient contact with the shaft 12, so that the magnetic fluid 17 is always present between the ball 37*b* and the shaft 12. The action and effect are the same as those of Embodiment 8.

Embodiment 10

Figure 11:
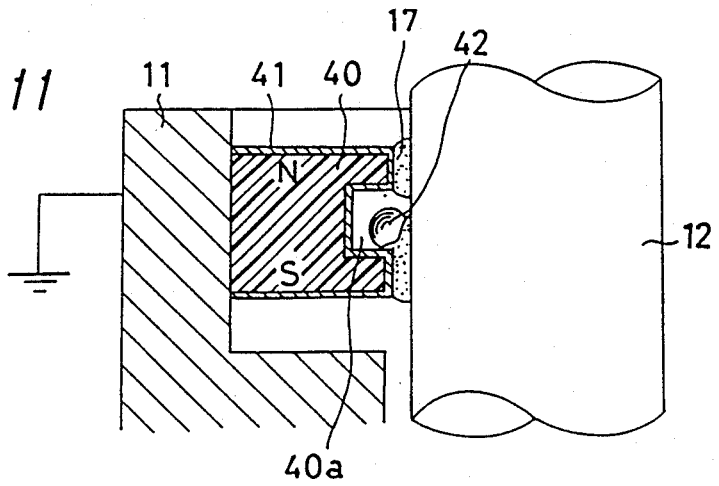
FIG. 11, a sectional view of embodiment 10.

FIG. 11 illustrates the tenth embodiment, wherein a non-magnetic electroconductive film (second member) 41 attached to an annular magnet 40, in which a concave groove 40*a* is formed on the internal circumferential surface thereof and immovably attached to a housing 11 together with the magnet 40 for enabling electroconduction is electrically connected to a shaft (first member) 12, in which a magnetic fluid 17 retained by the magnetic force of the magnet 40 is interposed between the shaft 12 and the non-magnetic electroconductive film 41, by means of a ball (slider) 42 coated with a non-magnetic electroconductive film on a magnetic ball. Because the core material of the ball 42 is magnetic in the structure described above, the ball 42 is absorbed on the non-magnetic electroconductive film 41 and the shaft 12 by the magnetic force of the magnet 40 through the medium of the magnetic fluid 17 and approaches these members to a proximity capable of metal contact or electroconduction. Although the action and effect do not differ from those in Embodiment 1, Embodiment 10 has an advantage in that stable electroconduction of the ball 42 and non-magnetic electroconductive film 41 can be ensured, because the ball 42 can be restrained in the concave groove in this Embodiment.

Embodiment 11

The eleventh embodiment, not illustrated, is an example in which a non-magnetic electroconductive film is used instead of the magnetic electroconductive film (second member) 27 in Embodiment 6 of FIG. 7, and a non-magnetic ball is used as a slider instead of the magnetic ball 30. In the present embodiment, the non-magnetic ball is brought into metal contact with the first and second members or to a close proximity capable of producing electroconduction in; both members by means of the surface tension of a magnetic fluid 28 exerting among the non-magnetic ball, the nonmagnetic electroconductive film (second member) and a magnetic slide plate (first member) 29. The action and effect are the same as those in Embodiment 6.

Embodiment 12

Figure 12:
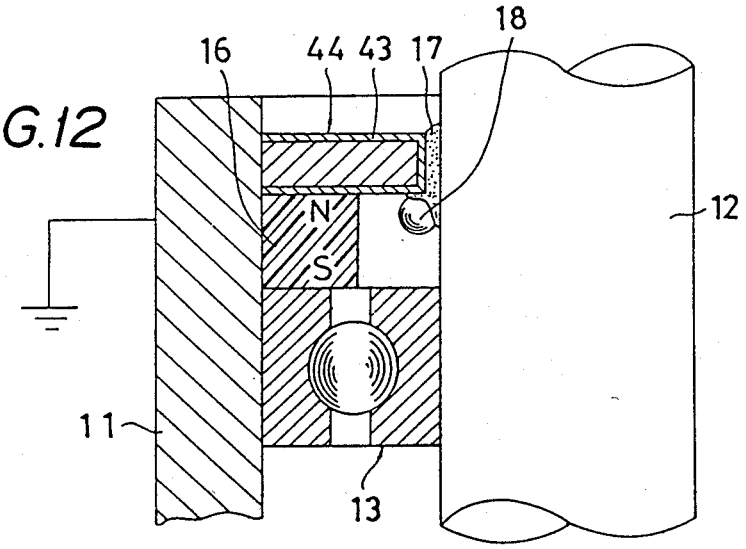
FIG. 12, a sectional view of Embodiment 12.

FIG. 12 illustrates the twelfth embodiment, which is a modification of Embodiment 4, shown in FIG. 5. In Embodiment 12, a pole piece 44 coated with a non-magnetic electroconductive film (second member) 43 is used instead of the pole piece (second member) 23 in FIG. 5 to restrain a ball (slider) 18 between the pole piece 44 and a bearing 13. The action and effect do not differ from those in Embodiment 4.

Embodiment 13

Figure 13:
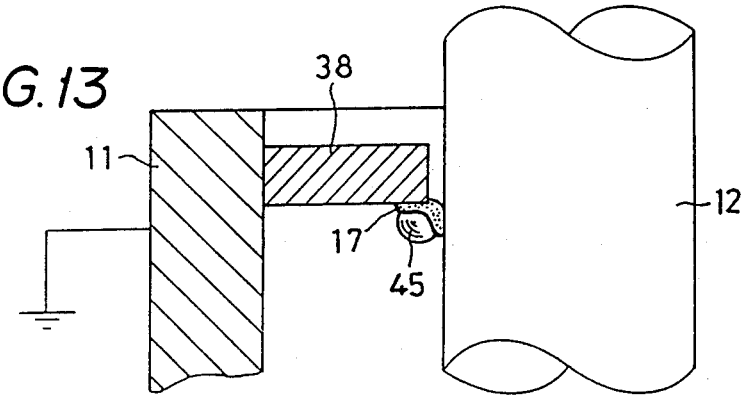
FIG. 13, a sectional view of Embodiment 13.

FIG. 13 illustrates the thirteenth embodiment in which a ball 45 produced by coating a magnetic ball with a nonmagnetic electroconductive film is used. A magnetic fluid 17 is retained between a shaft 12 and the ball (slider) 45 and between the ball 45 and a pole piece 38 by means of the magnetic force of the ball 45. The ball 45 is absorbed on the shaft 12 and the pole piece 38 by its own magnetic force and is brought into close proximity allowing metal contact therewith or electroconduction. The action and effect do not differ from those in Embodiment 1.

Embodiment 14

Figure 14:
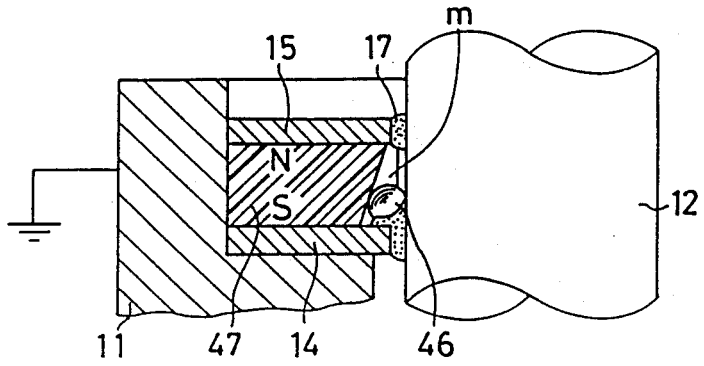
FIG. 14(*a*), a sectional view of Embodiment 14.
Figure 14:
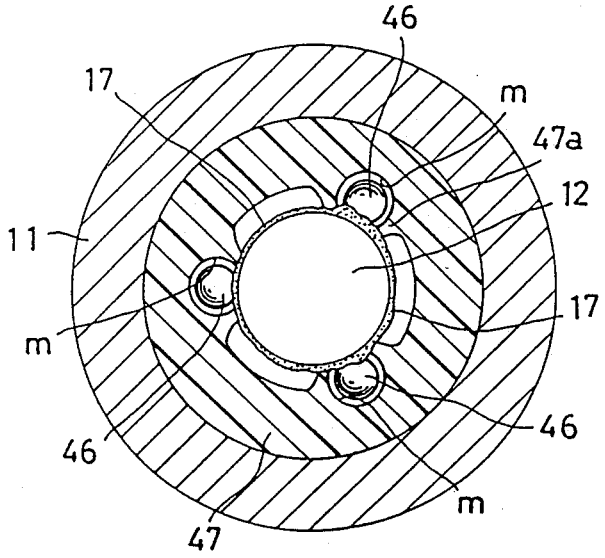

FIG. 14 illustrates the fourteenth embodiment which is a modification of Embodiment 1, shown in FIG. 1. In embodiment 14, non-magnetic balls 46 are substituted for a ball (slider) 18 shown in FIG. 2 and a magnet 45 used also for a retainer, that is, an annular magnet 47 having the three retainers 47*a* of the ball 46 distributed at regular intervals on the inner side thereof is substituted for the magnet 16. The inner surface of the retainer is formed of grooves m, in which a magnet 47 containing a ball 46 is fitted to a housing 11 across pole pieces 14 and 15. The respective balls 46 are brought into close proximity to the shaft 12 and the pole piece 14 to produce metal contact or electroconduction because of the surface tension of the magnetic fluid. The action and effect do not essentially differ from Embodiment 11.

Embodiment 15

Figure 15:
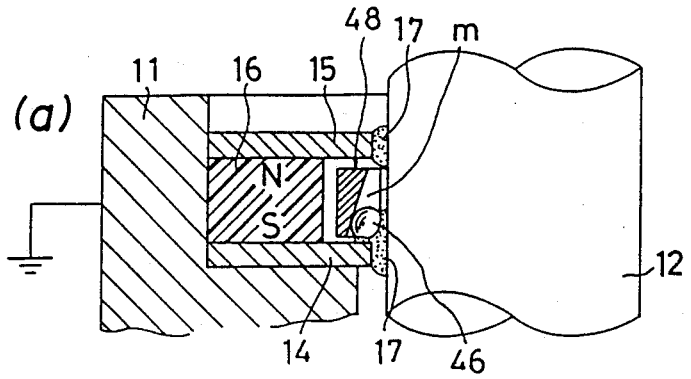
FIG. 15(*a*), a sectional view of Embodiment 15.
Figure 15:
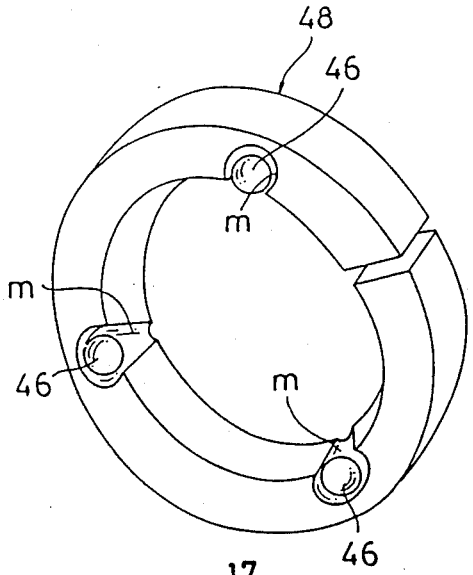

FIG. 15 illustrates the fifteenth embodiment which is a modification of Embodiment 1 shown in FIG. 2. In Embodiment 15, a non-magnetic ball 46 is used for the ball (slider) 18 in FIG. 2. The ball 46 is retained by grooves m having the conical surfaces of the retention portion 48*a* of a plastic C-type annular retainer 48 having a cut portion 48*a*. Under such a condition, the retainer 48 is fitted to a shaft 12 while it is remains open to some degree. The ball (slider) 46 is then brought into close proximity to the shaft (first member) 12 and a pole piece (second member) 14 utilizing the stability (spring force) of the retainer 48 to a distance capable of metal contact or electroconduction. The action and effect are the same as those in Embodiment 8.

Embodiment 16

Figure 16:
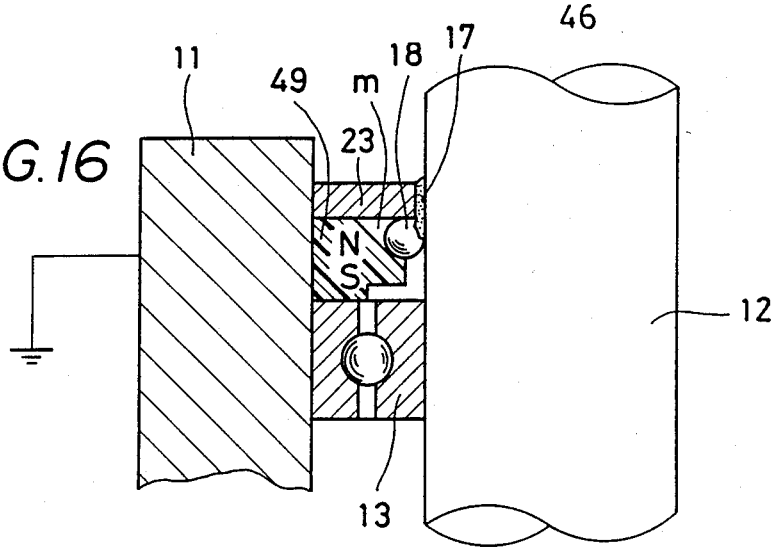
FIG. 16, a sectional view of Embodiment 16.

FIG. 16 illustrates the sixteenth embodiment, which is a modification of Embodiment 4 shown in FIG. 5. In Embodiment 16, a plastic magnet 49 is substituted for the magnet 16 in FIG. 5. the internal circumferential surface of the magnet 49 is cut at a slant to provide grooves which are V-shaped with regard to the cross-sections whereby a ball (slider) 18 is restrained in the grooves m. The rest of the structure is essentially the same as that in Embodiment 4.

Because the plastic magnet 49 does not have the physical property of hardness, and the grooves m are scraped off by contact with the ball 18, the surface hardness of the grooves m is enhanced by reforming with a hard coating using an ultra-violet hardening-type hard coating agent. the hard coating agents suited for surface reforming include thermosetting resins, thermoplastic synthetic resins and natural high-molecular-weight substances exemplified by phenol resins, alkyd resins, epoxy resins, polyacrylonitrile resins, polysulfon resins, aromatic polyamides, polybutadiene rubbers, chloroprene rubbers and the like. Other methods for surface reforming include film-forming treatment methods using inorganic compounds such as ceramic coating and ion plating, and general methods include sputtering ion plating evaporation, and plasma injection. The coating films include TiN, TiC, $TiO_2$, ZiN, SiC, $ZrO_2$, $NbB_2$, and Vc. It is possible to perform such surface treatments using ordinary magnets instead of the plastic magnets.

The action and effect do not essentially differ from those in Embodiment 4.

Embodiments 17 to 19

Figure 17:
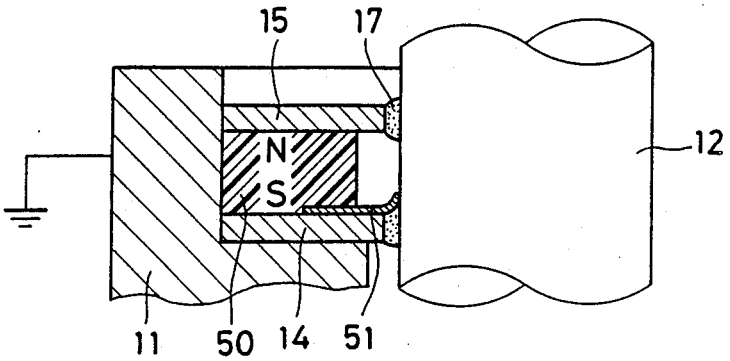
FIG. 17(*a*), a sectional view of Embodiment 17.
Figure 17:
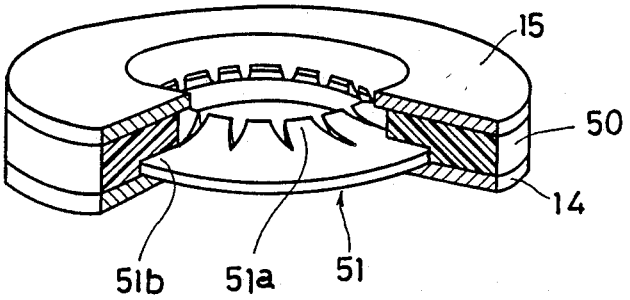
Figure 18:
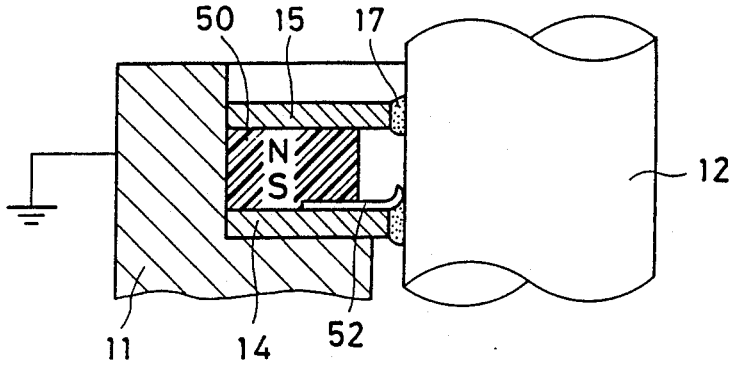
FIG. 18(*a*), a sectional view of Embodiment 18.
Figure 18:
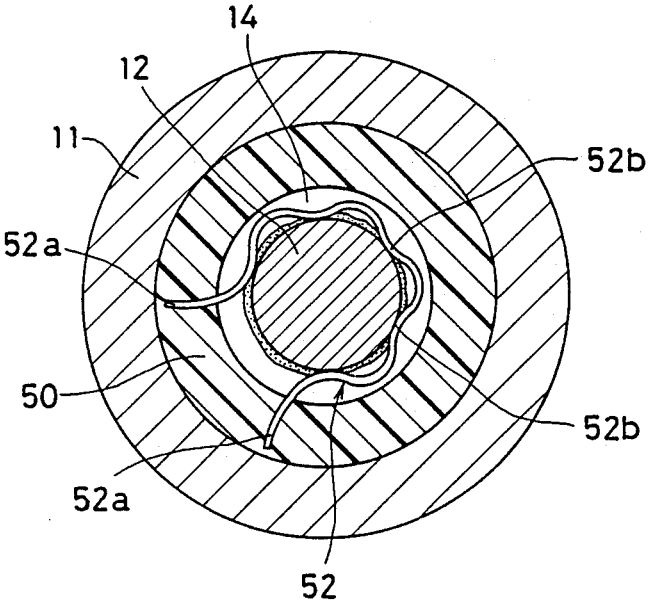
Figure 19:
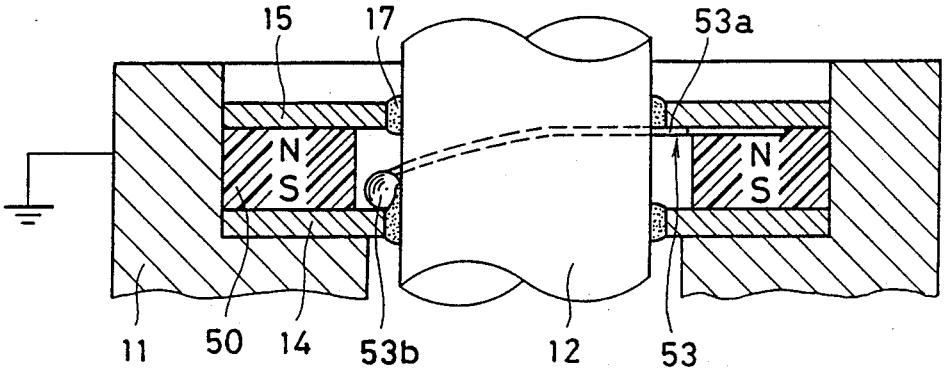
FIG. 19(*a*), a sectional view of Embodiment 19(*a*)
Figure 19:
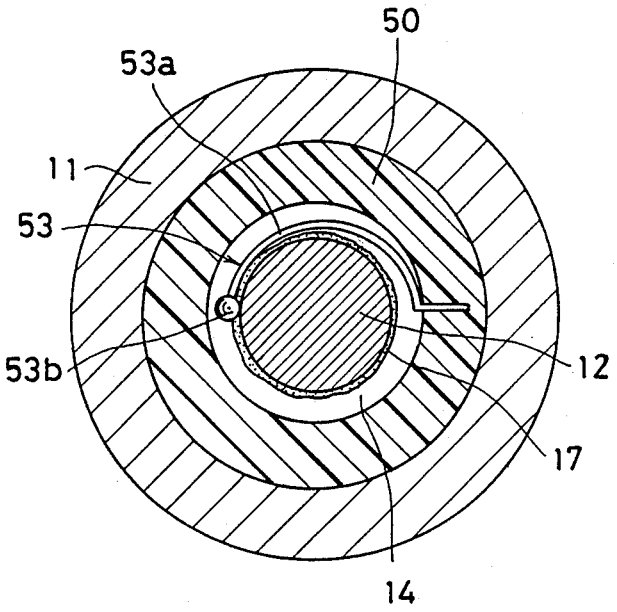

FIGS. 17 to 19 illustrate Embodiments 17 to 19, all of which are modifications of Embodiment 5 shown in FIG. 6.

In these embodiments, a plastic magnet 50 is used instead of the magnet 16 in FIG. 6. Electroconductive annular magnet spring members 51 and 52 are used in Embodiments 17 and 18, and an electroconductive ball-loaded magnetic spring member 53 is used in Embodiment 19 instead of the magnetic spring member 24 which is the slider.

The annular magnetic spring member (slider) 51 is provided with a plural number of contact segments 51*a* which are brought into resilient contact with a shaft (first member) 12 at the portion of a magnetic fluid 17 in the interior of the annulus. An annular portion 51*b* in the exterior of the annulus is fixed to a magnet 50 to bring it into metal contact with a pole piece (second member) 14.

The annular magnetic spring member (slider) 52 is processed by bending one magnetic spring member in the form of a star, in which an open end 52*a* is fixed to a magnet 50 to bring it into metal contact with a shaft (first member) 12.

A ball-loaded magnetic spring member (slider) 53 is formed by fixing a ball 53*b* to the tip of a curved magnetic spring member 53*a*. In the spring member 53, a ball 53*b* is brought into resilient contact with the shaft 12 by means of the elastic force of the magnetic spring member 53*a*, the base of which is brought into metal contact with a pole piece (second member) 15 fixed to a magnet 50.

Although the action and effect do not differ from those in Embodiment 5, Embodiments 17 and 18 are more advantageous in terms of assuring electroconductivity, because many contact points of the shaft (first member) with the annular magnetic spring member 51 and a contactor 52 are available.

In Embodiment 19, a ball 53*b* can be brought into resilient contact with a shaft first member) 12 and a pole piece (second member) 14 simultaneously. In such a construction, the shaft (first member) 12 can be electrically connected to a pole piece (second member) 14 by means of the ball 53*b* without using the magnetic spring member 53*a*, i.e., by using a non-conductive spring member.

Embodiments 20 and 21

Figure 20:
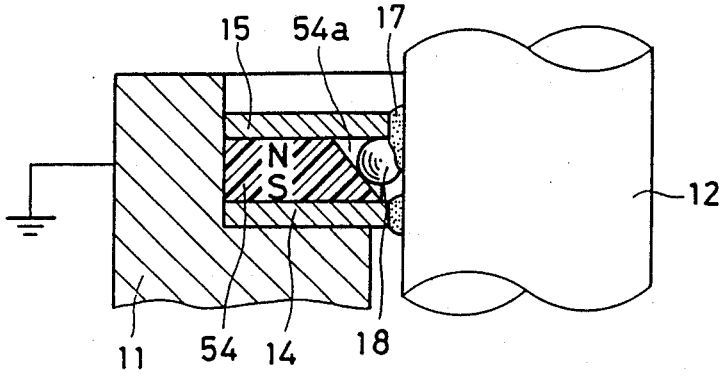
FIG. 20(*a*), a sectional view of Embodiment 20.
Figure 20:
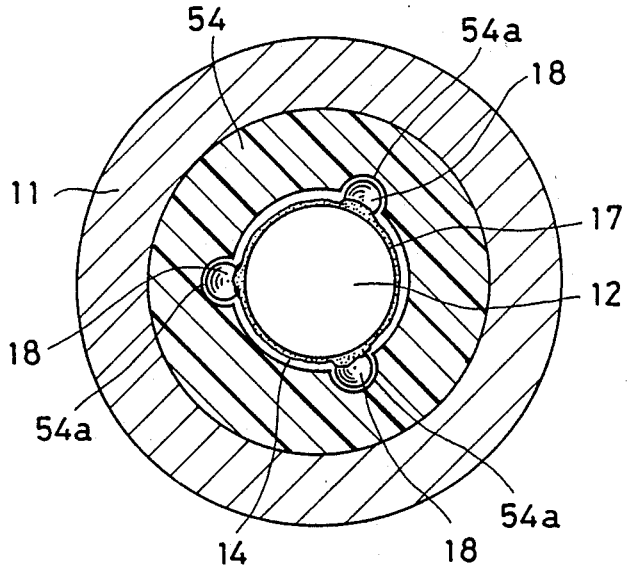
Figure 21:
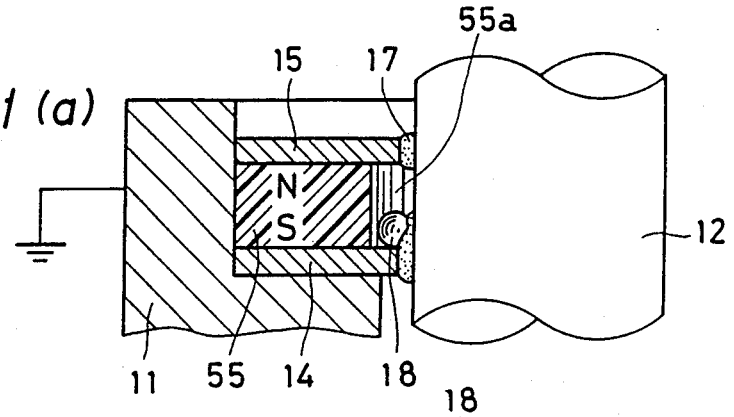
FIG. 21(*a*), a sectional view of Embodiment 21.
Figure 21:
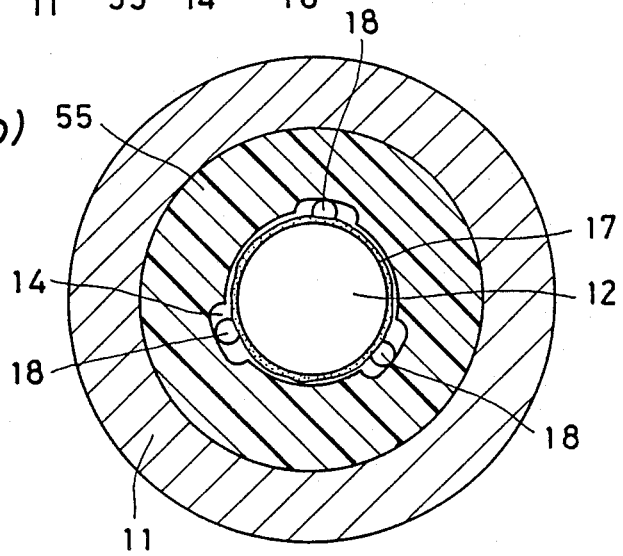
Figure 22:
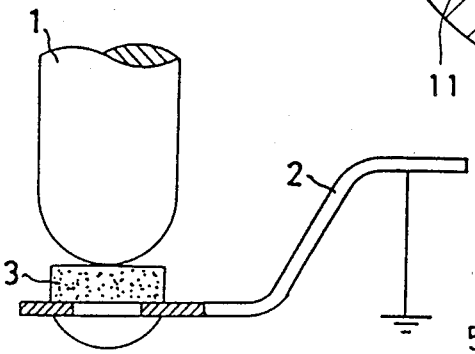
FIG. 22 (PRIOR ART)
FIG. 22, a side view of a conventional embodiment.
Figure 23:
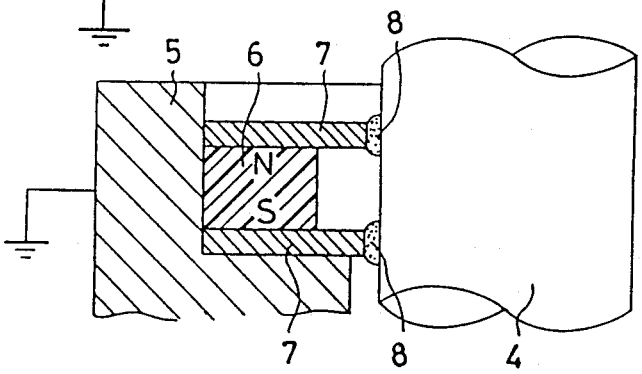
FIG. 23 (PRIOR ART)
FIG. 23, a sectional view of another conventional embodiment.

FIGS. 20 and 21 illustrate Embodiments 20 and 21, respectively, both of which are modifications of Embodiment 2 shown in FIG. 3.

In Embodiment 20, a plastic magnet 54 is also used for a retainer in place of a magnet 21 used for a retainer in FIG. 3. The inside of the magnet 54 is provided with three grooves 54*a* at a slant in relation to the axial direction, and distributed at regular intervals to restrain balls 18 in these grooves. The internal surfaces of the respective grooves 54*a* are cylindrical, the surfaces of which are modified by surface treatment to enhance surface hardness as is the case with Embodiment 16, because the surfaces may be scraped off by contact with the ball 18.

In Embodiment 21, a plastic magnet 55 for a retainer is also utilized in place of the magnet 21 given in FIG. 1, and the ball (slider) 18 is so incorporated as to be restrained in three wide grooves which are axially provided at regular intervals. The surface-reforming treatment of the grooves is carried out by a method similar to that in Embodiment 16.

Although the action and effect of both embodiments do not essentially differ from those in Embodiment 2, Embodiments 20 and 21 are more advantageous in that higher electroconductivity can be ensured.

In both embodiments, larger amounts of magnets 54 and 55 are available between pole pieces 14 and 15, because the interval between the magnet 54 or 55 and a shaft 12 is smaller than that in Embodiment 2. For this reason, there is an advantage in that greater leakage of magnetic flux increases the magnetic retaining force.

As described above, the present invention can ensure lubrication and electroconductivity at the slidable contact point simultaneously and provide an inexpensive electroconductive sliding apparatus.

What is claimed is:

1. An electroconductive sliding apparatus including:

(a) a first electroconductive member rotatively supported by at least one bearing;

(b) a second electroconductive member supported by said bearing for relative movement with said first electroconductive member and defining a slidable point therebetween;

(c) an electroconductive slider at said slidable point for sliding upon said first member to provide for the grounding of static electricity from said first member to said second member in order to avoid static electricity spark between said members;

(d) means to apply a force to said electroconductive slider to push the same against said second member;

(e) a lubricating magnetic fluid interposed between said first and said second electroconductive members in order to lubricate said slidable point between said electroconductive slider and said second member;

(f) means to produce a magnetic force between said first electroconductive member and said second electroconductive member to keep said magnetic fluid at said slidable point and to form a magnetic field around said slidable point;

whereby said slidable point is characterized by the existence of said magnetic fluid to be contactingly slided or to be floatingly slided at a distance capable of providing electroconductive grounding between said first electroconductive member and said second electroconductive member and being lubricated by said magnetic fluid.

2. The electroconductive sliding apparatus defined in claim 1, wherein said magnetic fluid works as sealing member between said first member and said second member.

3. The electroconductive sliding apparatus defined in claim 1, wherein said means to push the electroconductive slider against said second electroconductive member is the magnetic force means to keep the magnetic fluid at the slidable point.

4. An electroconductive sliding apparatus in accordance with claim I, wherein said means to push said electroconductive slider against said second member is a spring force of a spring member mounted to said first member.

5. An electroconductive sliding apparatus in accordance with claim 1, wherein said slider is a spring member.

6. An electroconductive sliding apparatus in accordance with claim 1, wherein said slider is a ball.

7. An electroconductive sliding apparatus in accordance with claim 1, wherein said magnetic force means is supplied by a magnet.

8. An electroconductive sliding apparatus in accordance with claim 1, wherein said slider is a ball retained in a plastic cage fitted to said first member.

9. An electroconductive sliding apparatus in accordance with claim I, wherein a groove is provided in said second member, and said slider is a ball retained in said groove.

10. An electroconductive sliding apparatus in accordance with claim 1, wherein said slider is a bar type spring member.

11. An electroconductive sliding apparatus in accordance with claim 3, wherein a hole is placed in said magnet, and a spring member is placed in said hole to form said slider.

12. An electroconductive sliding apparatus in accordance with claim 1, wherein said slider is a spring loaded ball.

13. An electroconductive sliding apparatus in accordance with claim 3, wherein said magnet is coated with a nonmagnetic electroconductive film, is annular having an annular groove therein, and said slider is a ball retained in said annular groove.

14. An electroconductive sliding apparatus in accordance with claim 1, wherein said slider is in the form of a ball retained between a pole piece and said bearing.

15. An electroconductive sliding apparatus in accordance with claim 1, wherein said slider is a magnetic ball coated with a nonmagnetic electroconductive film, said magnetic ball being absorbed on said first member and a pole piece.

16. An electroconductive sliding apparatus in accordance with claim 3, wherein said magnet is an annular magnet having a plurality of retainers and surrounding said first member, and having a plurality of nonmagnetic balls rotatively mounted in said retainers.

17. An electroconductive sliding apparatus in accordance with claim 1, and including an annular plastic retainer substantially surrounding said first member and having a plurality of grooves therein, and a plurality of nonmagnetic balls mounted in said retainer to form said slider.

18. An electroconductive sliding apparatus in accordance with claim 3, wherein said magnet is a plastic magnet having a plurality of V-shaped grooves therein, and having a plurality of balls retained in said V-shaped grooves to form said slider.

19. An electroconductive sliding apparatus in accordance with claim 3, wherein said magnet is a plastic magnet having a retaining groove therein, and further having an annular magnetic spring member retained in said groove to form said slider.

20. An electroconductive sliding apparatus in accordance with claim 1, wherein said slider is a curved spring member having a ball mounted on the tip thereof.

21. An electroconductive sliding apparatus in accordance with claim 3, wherein said magnet has an axial groove therein, and said slider is a ball retained in said axial groove.

22. An electroconductive sliding apparatus including:

(a) a first electroconductive member supported by at least one bearing;

(b) a second electroconductive member rotatably supported by said bearing for relative movement with said first electroconductive member and defining a slidable point therebetween;

(c) An electroconductive slider at said slidable point for sliding upon said first member while said second member is rotating to provide for the grounding of static electricity in order to avoid static electricity spark between said members;

(d) means to apply a force to said electroconductive slider to push the same against said member and hold it stationary there against for rotation with said second member;

(e) a lubricating magnetic fluid interposed between said first and said second electroconductive members in order to lubricate said slidable point between said electroconductive slider and said second member;

(f) means to produce a magnetic force between said first electroconductive member and said second electroconductive member to keep said magnetic fluid at said slidable point and to form a magnetic field around said slidable point;

whereby said slidable point is characterized by the existence of said magnetic fluid to be contactingly slided or to be floatingly slided at a distance capable of providing electroconductive grounding between said first electroconductive member and said second electroconductive member and being lubricated by said magnetic fluid.

23. An electroconductive sliding apparatus in defined in claim 22, wherein said magnetic fluid works as sealing member between said first member and said second member.

24. An electroconductive sliding apparatus in defined in claim 22, wherein said means to push the electroconductive slider against said second electroconductive member is the magnetic force means to keep the magnetic fluid at the slidable point.

25. An electroconductive sliding apparatus in accordance with claim 22, wherein said means to push said electroconductive slider against said second member is a spring force of a spring member mounted to said first member.

26. An electroconductive sliding apparatus in accordance with claim 22, wherein said slider is a spring member.

27. An electroconductive sliding apparatus in accordance with claim 22, wherein said slider is a ball.

28. An electroconductive sliding apparatus in accordance with claim 22, wherein said magnetic force means is supplied by a magnet.

* * * * *